US006629759B2

(12) United States Patent
Lawrence et al.

(10) Patent No.: US 6,629,759 B2
(45) **Date of Patent: *Oct. 7, 2003**

(54) INK JET PRINTING METHOD

(75) Inventors: Kristine B. Lawrence, Rochester, NY (US); Paul B. Merkel, Victor, NY (US); Hwei-Ling Yau, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 6 days.

This patent is subject to a terminal disclaimer.

(21) Appl. No.: 09/999,405

(22) Filed: Oct. 31, 2001

(65) Prior Publication Data

US 2003/0151654 A1 Aug. 14, 2003

(51) Int. Cl.[7] ..... B41J 2/01
(52) U.S. Cl. ..... 347/105; 428/32.24
(58) Field of Search ..... 428/195, 500, 428/32.24; 347/105, 106

(56) References Cited

U.S. PATENT DOCUMENTS 4,381,946 A * 5/1983 Uehara et al. ..... 106/22
4,781,758 A * 11/1988 Gendler et al. ..... 106/22
4,926,190 A 5/1990 Laver
5,384,235 A 1/1995 Chen et al.
6,020,032 A * 2/2000 Romano et al. ..... 427/411
6,045,917 A 4/2000 Missell et al.
6,110,585 A * 8/2000 Shaw-Klein ..... 428/341

FOREIGN PATENT DOCUMENTS

JP 08-183242 * 7/1996 ..... B41M/5/00

* cited by examiner

*Primary Examiner*—Bruce H. Hess
*Assistant Examiner*—Michael E. Grendzynski
(74) *Attorney, Agent, or Firm*—Doreen M. Wells

(57) ABSTRACT

An ink jet printing method having the steps of: A) providing an ink jet printer that is responsive to digital data signals; B) loading the printer with an ink jet recording element having a support having thereon the following layers in order: i) a base layer having a polymeric binder and a polymeric mordant; and ii) an overcoat layer having a polymeric UV-absorbing material; C) loading the printer with an ink jet ink composition of water, a humectant, and a water-soluble dye; and D) printing on the overcoat layer using the ink jet ink in response to the digital data signals.

19 Claims, No Drawings

INK JET PRINTING METHOD

CROSS REFERENCE TO RELATED APPLICATIONS

Reference is made to commonly assigned, co-pending U.S. patent applications: Ser. No. 09/999,496 by Lawrence et al., filed Oct. 31, 2001 entitled "Ink Jet Recording Element"; Ser. No. 09/998,737 by Lawrence et al., filed Oct. 31, 2001 entitled "Ink Jet Printing Method"; and Ser. NO. 09/999,374 by Lawrence et al., filed Oct. 31, 2001 entitled "Ink Jet Recording Element".

FIELD OF THE INVENTION

This invention relates to an ink jet printing process for improving the Dmax density and light stability of an ink jet printed image containing a water-soluble dye.

BACKGROUND OF THE INVENTION

Ink jet printing is a non-impact method for producing images by the deposition of ink droplets in a pixel-by-pixel manner to an image-recording element in response to digital signals. There are various methods that may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to an ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation. Ink jet printers have found broad applications across markets ranging from industrial labeling to short run printing to desktop document and pictorial imaging.

The inks used in the various ink jet printers can be classified as either dye-based or pigment-based. A dye is a colorant that is molecularly dispersed or solvated by a carrier medium. The carrier medium can be a liquid or a solid at room temperature. A commonly used carrier medium is water or a mixture of water and organic co-solvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor light-fastness. When water is used as the carrier medium, such inks also generally suffer from poor water-fastness.

An ink jet recording element typically comprises a support having on at least one surface thereof an ink-receiving or image-forming layer. The ink-receiving layer may be a polymer layer that swells to absorb the ink or a porous layer that imbibes the ink via capillary action.

Ink jet prints, prepared by printing onto ink jet recording elements, are subject to environmental degradation. They are especially vulnerable to water smearing, dye bleeding, coalescence and light fade. For example, since ink jet dyes are water-soluble, they can migrate from their location in the image layer when water comes in contact with the receiver after imaging. Highly swellable hydrophilic layers can take an undesirably long time to dry, slowing printing speed, and will dissolve when left in contact with water, destroying printed images. Porous layers speed the absorption of the ink vehicle, but often suffer from insufficient gloss and severe light fade or fade induced by atmospheric ozone.

U.S. Pat. No. 4,926,190 relates to the use of UV-absorbers in a recording material. However, there is a problem with these materials in that they are not polymeric and may tend to wander out of the layer.

U.S. Pat. No. 5,384,235 relates to the use of polymeric UV-absorbers in a silver halide color photographic element. However, there is no disclosure in this patent of the use of these materials in an ink jet recording system.

U.S. Pat. No. 6,045,917 relates to the use of cationic mordants in an ink jet image-recording layer. However, there is a problem with this element in that images formed in the image-receiving layer have poor light stability, as will be shown hereafter.

It is an object of this invention to provide an ink jet printing method using anionic dyes suitable for use in aqueous inks for ink jet printing that will provide images with better Dmax density and light stability.

SUMMARY OF THE INVENTION

This and other objects are achieved in accordance with this invention which relates to an ink jet printing method, comprising the steps of:

A) providing an ink jet printer that is responsive to digital data signals;

B) loading the printer with an ink jet recording element comprising a support having thereon the following layers in order:
   i) a base layer comprising a polymeric binder and a polymeric mordant; and
   ii) an overcoat layer comprising a polymeric UV-absorbing material;

C) loading the printer with an ink jet ink composition comprising water, a humectant, and a water-soluble dye; and D) printing on the overcoat layer using the ink jet ink in response to the digital data signals.

It has been found that use of the above dyes and image-receiving layer provides excellent Dmax density and light stability.

DETAILED DESCRIPTION OF THE INVENTION

Any water-soluble dye may be used in the composition employed in the method of the invention such as a dye having an anionic group, e.g., a sulfo group or a carboxylic group. The anionic, water-soluble dye may be any acid dye, direct dye or reactive dye listed in the COLOR INDEX but is not limited thereto. Metallized and non-metallized azo dyes may also be used as disclosed in U.S. Pat. No. 5,482,545, the disclosure of which is incorporated herein by 09/202043, the disclosures of which are incorporated herein by reference. In a preferred embodiment, the anionic, water-soluble dye which may be used in the composition employed in the method of the invention is a metallized azo dye, a non-metallized azo dye, a xanthene dye, a metallophthalocyanine dye or a sulfur dye. Mixtures of these dyes may also be used. Examples of dyes that may be used in the invention are as follows:

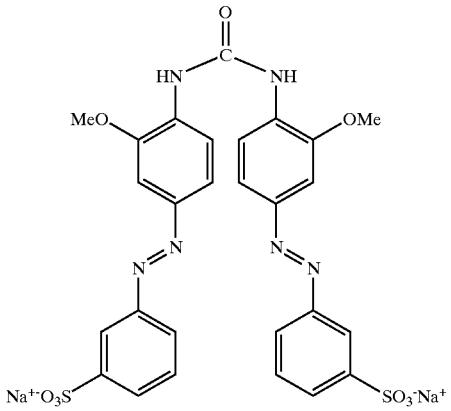

Dye 1 (Me is methyl)
Intrajet Yellow 132®
(Zeneca Specialties)

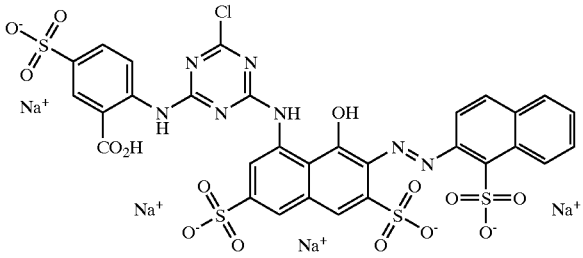

Dye 2
Reactive Red 31
(Lyson, Inc.)

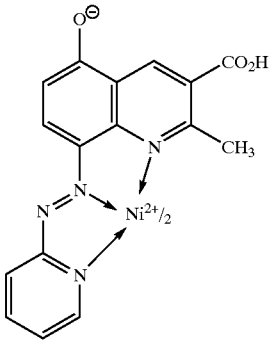

Dye 3

-continued

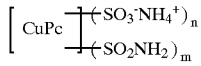

Dye 4
Direct Blue 199
(CuPc is copper phthalocyanine)
(Clariant Corp.)

The dyes described above may be employed in any amount effective for the intended purpose. In general, good results have been obtained when the dye is present in an amount of from about 0.2 to about 5% by weight of the ink jet ink composition, preferably from about 0.3 to about 3% by weight. Dye mixtures may also be used.

In a preferred embodiment of the invention, the polymeric UV-absorbing material comprises the following repeating units:

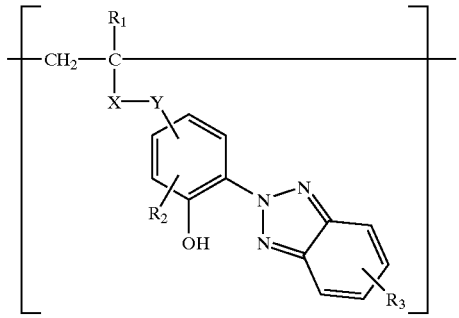

wherein:

$R_1$ represents H or $CH_3$;

$R_2$ represents H, halogen, alkoxy or a straight chain or branched alkyl group having from 1 to about 8 carbon atoms;

$R_3$ represents H, Cl, alkoxy or an alkyl group having from 1 to about 4 carbon atoms;

X represents COO, CONH or aryl; and

Y represents an alkylene group having from about 2 to about 10 carbon atoms or $(CH_2)_nO$ wherein n is 1 to about 4.

Specific examples of polymeric UV-absorbing repeating units useful in the invention include the following:

TABLE 1

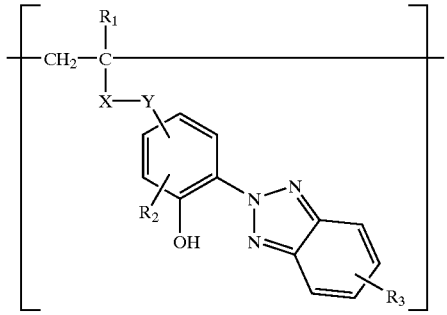

| UV-Absorber | $R_1$ | $R_2$ | $R_3$ | X | Y |
|---|---|---|---|---|---|
| UV-1 | $CH_3$ | H | H | COO | $(CH_2)_2$ |
| UV-2 | H | H | Cl | COO | $(CH_2)_3$ |

TABLE 1-continued

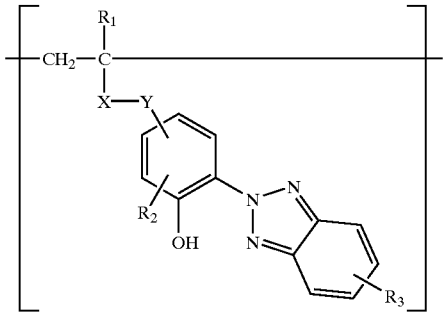

| UV-Absorber | $R_1$ | $R_2$ | $R_3$ | X | Y |
|---|---|---|---|---|---|
| UV-3 | H | H | H | 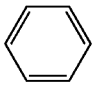 | $CH_2O$ |
| UV-4 | $CH_3$ | $C(CH_3)_3$ | H | COO | $(CH_2)_3$ |
| UV-5 | H | $CH_3$ | H | CONH | $CH_2$ |
| UV-6 | H | $CH_3$ | $OCH_3$ | CONH | $CH_2$ |
| UV-7 | H | $C(CH_3)_3$ | Cl | CONH | $CH_2$ |
| UV-8 | $CH_3$ | H | H | COO | $(CH_2)_2OCONH$ |
| UV-9 | $CH_3$ | Cl | H | COO | $_2C—CH(OH)—CH_2O$ |
| UV-10 | $CH_3$ | H | Cl | COO | $(CH_2)_3$ |
| UV-11 | H | H | Cl | COO | $(CH_2)_3$ |
| UV-12 | $CH_3$ | H | Cl | COO | $CH_2)_2—O—C(=O)—(CH_2)_2$ |
| UV-13 | H | H | Cl | COO | $CH_2)_2—O—C(=O)—(CH_2)_2$ |
| UV-14 | $CH_3$ | H | Cl | COO | $(CH_2)_2—NH—C(=O)—(CH_2)_2$ |
| UV-15 | H | $CH_3$ | H | 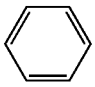 | $CH_2$ |
| UV-16 | H | $CH_3$ | Cl | COO | $(CH_2)_3$ |
| UV-17 | H | $CH_3$ | H | COO | $(CH_2)_2$ |
| UV-18 | $CH_3$ | H | Cl | COO | $(CH_2)_2O$ |
| UV-19 | H | H | Cl | COO | $(CH_2)_2$ |

The UV absorbing repeating units illustrated in Table 1 above can also be polymerized in the presence of two or more comonomers. For example, a combination of ethyl acrylate and acrylamido-2,2'-dimethyl propane sulfonic acid monomers can be copolymerized with UV absorbing repeating unit UV-1 above. Specific examples of polymeric UV absorbing materials useful for this invention are summarized below:

UVL-1: poly-(UV-1)-co-ethyl acrylate-co-2-sulfo-1,1-dimethylethylacrylamide, sodium salt (1:1:0.05 molar ratio)

UVL-2: poly-(UV-2)-co-ethyl acrylate-2-sulfo-1,1-dimethylethylacrylamide, sodium salt (1:1:0.05 molar ratio)

UVL-3: poly-(UV-3)-co-butyl acrylate-co-2-sulfo-1,1dimethylethyl acrylamide sodium salt (1:2:0.05 molar ratio)

The polymeric UV-absorbing materials employed in the invention can be used in an amount of from 0.05 to about 4.0 $m^2$, preferably from about 0.20 to about 1.5 $g/m^2$.

Any polymeric mordant can be used in the invention. In a preferred embodiment, the mordant can be a cationic protonated amine-containing polymer or a polymer that contains a quaternary ammonium group. Examples of these mordants include poly(1-vinylimidazole), poly(4-vinylpyridine), poly(styrene-co-N-benzyl-N,N-dimethyl-N-vinylbenzyl-ammonium chloride-co-divinylbenzene) (49:49:2 mole ratio), poly(N,N,N-tributyl-N-vinylbenzyl-ammonium chloride), poly(N,N-dimethyl-N-benzyl-N-vinylbenzyl-ammonium chloride), poly(styrene-co-N,N,N-trimethyl-N-vinylbenzyl-ammonium chloride) (1:1 mole ratio), poly(N,N,N-trimethyl-N-vinylbenzyl-ammonium chloride-co-divinylbenzene) (87:13 mole.ratio), poly(N,N-dimethyl-N-octadecyl-N-vinylbenzyl-ammonium chloride), poly(styrene-co-1-vinylimidazole-co-3-hydroxyethyl-1-vinylimidazolium chloride) (5:4:1 mole ratio), poly(styrene-co-1-vinylimidazole-co-3-benzyl-1-vinylimidazolium chloride) (5:4:1 mole ratio), poly(styrene-co-1-vinylimidazole-co-3-hydroxyethyl-1-vinylimidazolium chloride) (2:2:1 mole ratio), poly(styrene-co-4-vinylpyridine-co-1-hydroxyethyl-4-vinylpyridinium chloride) (5:4:1 mole ratio), poly(diallydimethylammonium chloride) and chitosan.

The polymeric mordant employed in the invention can be used in an amount of from 0.2 to about 16 g/m$^2$, preferably from about 0.4 to about 8 g/m$^2$.

The binder employed in the base layer is preferably a hydrophilic polymer. Examples of hydrophilic polymers useful in the invention include polyvinyl alcohol, polyvinyl pyrrolidone, poly(ethyl oxazoline), poly-N-vinylacetamide, non-deionized or deionized Type IV bone gelatin, acid processed ossein gelatin, pig skin gelatin, acetylated gelatin, phthalated gelatin, oxidized gelatin, chitosan, poly(alkylene oxide), sulfonated polyester, partially hydrolyzed poly(vinyl acetate/vinyl alcohol), poly(acrylic acid), poly(1-vinyl pyrrolidone), poly(sodium styrene sulfonate), poly(2-acrylamido-2-methane sulfonic acid), polyacrylamide or mixtures thereof. In a preferred embodiment of the invention, the binder is gelatin or poly(vinyl alcohol).

The hydrophilic polymer may be present in an amount of from about 0.1 to about 30 g/m$^2$, preferably from about 0.2 to about 16 g/m$^2$ of the base layer.

The weight ratio of polymeric mordant to binder is from about 1:99 to about 8:2, preferably from about 1:9 to about 4:6.

Latex polymer particles and/or inorganic oxide particles may also be used in the binder in the base layer to increase the porosity of the layer and improve the dry time. Preferably, the latex polymer particles and /or inorganic oxide particles are cationic or neutral. Preferably, the latex polymer particles are porous. Examples of inorganic oxide particles include barium sulfate, calcium carbonate, clay, silica or alumina, or mixtures thereof. In that case, the weight % of particulates in the image receiving layer is from about 70 to about 98%, preferably from about 80 to about 95%.

The pH of the aqueous ink compositions employed in the invention may be adjusted by the addition of organic or inorganic acids or bases. Useful inks may have a preferred pH of from about 2 to 10, depending upon the type of dye being used. Typical inorganic acids include hydrochloric, phosphoric and sulfuric acids. Typical organic acids include methanesulfonic, acetic and lactic acids. Typical inorganic bases include alkali met al hydroxides and carbonates. Typical organic bases include ammonia, triethanolamine and tetramethylethylenediamine.

A humectant is employed in the ink jet composition employed in the invention to help prevent the ink from drying out or crusting in the orifices of the printhead. Examples of humectants which can be used include polyhydric alcohols, such as ethylene glycol, diethylene glycol, triethylene glycol, propylene glycol, tetraethylene glycol, polyethylene glycol, glycerol, 2-methyl-2,4-pentanediol 1,2,6-hexanetriol and thioglycol; lower alkyl mono- or di-ethers derived from alkylene glycols, such as ethylene glycol mono-methyl or monoethyl ether, diethylene glycol mono-methyl or mono-ethyl ether, propylene glycol mono-methyl or mono-ethyl ether, triethylene glycol mono-methyl or mono-ethyl ether, diethylene glycol di-methyl or di-ethyl ether, and diethylene glycol monobutylether; nitrogen-containing cyclic compounds, such as pyrrolidone, N-methyl-2-pyrrolidone, and 1,3-dimethyl-2-imidazolidinone; and sulfur-containing compounds such as dimethyl sulfoxide and tetramethylene sulfone. A preferred humectant for the composition employed in the invention is diethylene glycol, glycerol, or diethylene glycol monobutylether.

Water-miscible organic solvents may also be added to the aqueous ink employed in the invention to help the ink penetrate the receiving substrate, especially when the substrate is a highly sized paper. Examples of such solvents include alcohols, such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofurfuryl alcohol; ketones or ketoalcohols such as acetone, methyl ethyl ketone and diacetone alcohol; ethers, such as tetrahydrofuran and dioxane; and esters, such as, ethyl lactate, ethylene carbonate and propylene carbonate.

Surfactants may be added to adjust the surface tension of the ink to an appropriate level. The surfactants may be anionic, cationic, amphoteric or nonionic.

A biocide may be added to the composition employed in the invention to suppress the growth of microorganisms such as molds, fungi, etc. in aqueous inks. A preferred biocide for the ink composition employed in the present invention is Proxel® GXL (Zeneca Specialties Co.) at a final concentration of 0.0001–0.5 wt. %.

A typical ink composition employed in the invention may comprise, for example, the following substituents by weight: colorant (0.05–5%), water (20–95%), a humectant (5–70%), water miscible co-solvents (2–20%), surfactant (0.1–10%), biocide (0.05–5%) and pH control agents (0.1–10%).

Additional additives that may optionally be present in the ink jet ink composition employed in the invention include thickeners, conductivity enhancing agents, anti-kogation agents, drying agents, and defoamers.

The ink jet inks employed in this invention may be employed in ink jet printing wherein liquid ink drops are applied in a controlled fashion to an ink receptive layer substrate, by ejecting ink droplets from a plurality of nozzles or orifices of the print head of an ink jet printer.

The image-recording layer used in the process of the present invention can also contain various known additives, including matting agents such as titanium dioxide, zinc oxide, silica and polymeric beads such as crosslinked poly (methyl methacrylate) or polystyrene beads for the purposes of contributing to the non-blocking characteristics and to control the smudge resistance thereof; surfactants such as non-ionic, hydrocarbon or fluorocarbon surfactants or cationic surfactants, such as quaternary ammonium salts, fluorescent dyes; pH controllers; anti-foaming agents; lubricants; preservatives; viscosity modifiers; dye-fixing agents, waterproofing agents, dispersing agents, UV-absorbing agents, mildew-proofing agents; mordants; antistatic agents, anti-oxidants, optical brighteners, and the like. A hardener may also be added to the ink-receiving layer if desired.

The support for the ink jet recording element used in the invention can be any of those usually used for ink jet receivers, such as paper, resin-coated paper, polyesters, or microporous materials such as polyethylene polymer-containing material sold by PPG Industries, Inc., Pittsburgh, Pa. under the trade name of Teslin® Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxally oriented support laminates. Biaxally oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxally oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The support used in the invention may have a thickness of from about 50 to about 500 $\mu$m, preferably from about 75 to 300 $\mu$m. Antioxidants, antistatic agents, plasticizers and other known additives may be incorporated into the support, if desired. In a preferred embodiment, paper is employed.

In order to improve the adhesion of the image-recording layer to the support, the surface of the support may be subjected to a corona-discharge-treatment prior to applying the image-recording layer.

In addition, a subbing layer, such as a layer formed from a halogenated phenol or a partially hydrolyzed vinyl chloride-vinyl acetate copolymer can be applied to the surface of the support to increase adhesion of the image recording layer. If a subbing layer is used, it should have a thickness (i.e., a dry coat thickness) of less than about 2 $\mu$m.

The image-recording layer may be present in any amount that is effective for the intended purpose. In general, good results are obtained when it is present in an amount of from about 2 to about 60 g/m$^2$, preferably from about 6 to about 40 g/m$^2$, which corresponds to a dry thickness of about 2 to about 50 $\mu$m, preferably about 6 to about 40 $\mu$m.

The overcoat layer may be present in any amount that is effective for the intended purpose. In general, good results are obtained when it is present in an amount of from about 1.1 to about 10.7 g/m$^2$, preferably from about 1.6 to about 5.4 g/m$^2$, which corresponds to a dry thickness of about 1.0 to about 10 $\mu$m, preferably about 1.5 to about 5 $\mu$m.

The following examples illustrates the utility of the present invention.

EXAMPLES

The following mordants were used as controls in the image-recording layer:

MP-1: poly(N-vinylbenzyl-N,N,N-trimethylammonium chloride-co-divinylbenzene) (about 90/10 mol %) (U.S. Pat. No. 6,045,917)

MP-2: poly(styrene-co-N-vinylbenzyl-N,N,N-trimethylammonium chloride-co-divinylbenzene) (about 49/49/2 mol %) (U.S. Pat. No. 6,045,917)

MP-3: poly(styrene-co-N-vinylimidazole-co-3-hydroxyethyl-1-vinylimidazolium chloride) (about 50/40/10 mol %)

Example 1

Synthesis of UVL-1

260 g of deionized water, 2.26 g of 20% sodium N-methyl-N-oleoyltaurate (surfactant Igepon T-77(®), and 26 g of acetone were mixed in a 500 mL, 4-necked round bottom flask equipped with a mechanical stirrer, nitrogen inlet, and condenser. The flask was immersed in a constant temperature bath at 80° C. and heated for 30 minutes with nitrogen purging through. The monomer solution was composed of 6.46 g of 2-(2'-hydroxy-5-methacrylyloxyethylphenyl)-2H-benzotriazole (0.02 mole), 2.00 g of ethylacrylate (0.02 mole), 0.23 g of 2-sulfo-1,1-dimethylethylacrylamide, sodium salt (0.001 mole) and 130 mL of N,N-dimethylformamide. The co-feed solution was made of 0.9 g of Igepon T-77® (20%), 1.8 g of sodium persulfate, and 20 g of deionized water. 3.91 g of 5% potassium persulfate was added to the reactor and stirred for 3 minutes. The monomer and co-feed solution were pumped into the reactor over 4 hours. The polymerization was continued for 8 hours. The latex was cooled, filtered and dialyzed against distilled water overnight. The latex was then concentrated down by an Amicon Ultrafiltration unit to the desirable concentration.

Example 2

Synthesis of UVL-3

UVL-3 was prepared by the identical method, except a mixture of 6.86 g of 2-(2-hydroxy-4-m&p-vinylbenzyloxyphenyl)benzotriazole (60:40) (0.02 mole), 5.12 g of butyl acrylate (0.04 mole), 0.23 g of 2-sulfo-1,1dimethylethyl acrylamide sodium salt (0.001 mole) and 130 mL of N,N-dimethylformamide were used as the monomer solution.

Example 3

Light Stability in Gelatin Based Coatings

Preparation of a Water Soluble, Anionic Dye Ink Composition, I-1

Ink I-1 containing Dye 1 identified above was prepared by mixing the dye concentrate (3.1%) with de-ionized water containing humectants of diethylene glycol (Aldrich Chemical Co.) and glycerol (Acros Co.), each at 6%, a biocide, Proxel GEL® biocide (Zeneca Specialties) at 0.003 wt. %, and a surfactant, Surfynol 465® (Air Products Co.) at 0.05 wt. %.

The dye concentration was based on solution absorption spectra and chosen such that the final ink when diluted 1:1000, would yield a transmission optical density of approximately 1.0.

Preparation of a Water Soluble, Anionic Dye Ink Composition, I-2

Ink I-2 containing Dye 2 identified above (Reactive Red 31, CAS-12237-00-2) was composed of Novajet Magenta Ink (Lyson Inc.) prepared by mixing 100 g of the commercial ink with 0.5 g of Surfynol 465® surfactant (Air Products Inc.).

Preparation of Control Ink Recording Elements C-1 through C-3

The composite side of a polyethylene resin-coated photographic grade paper based support was corona discharge treated prior to coating. Control Ink Recording Elements were composed of a mixture of 0.86 g/m$^2$ of control polymers MP-1 through MP-3, 7.75 g/m$^2$ of gelatin and 0.09 g/m$^2$ of S-100 12 $\mu$m polystyrene beads (ACE Chemical Co.), and coated from distilled water on the above mentioned paper support. In the preparation of C-3, a 60:40 mixture of distilled water to methanol was used in place of distilled water to dissolve MP-3.

Preparation of Invention Ink Recording Elements E-1 Through E-3

Recording elements E-1 through E-3 of the invention were prepared by overcoating C-1 through C-3 prepared above with a mixture of 0.61 g/m$^2$ of UVL-1, 1.51 g/m$^2$ of gelatin and 0.02 g/m$^2$ of Olin 10G® surfactant from distilled water.

Preparation of Invention Ink Recording Elements E-4 Through E-5

Recording elements E-4 through E-5 of the invention were prepared analogous to E-1 through E-3 above except the overcoat layer was coated over C-1 and C-2 only and 0.67 g/m$^2$ of UVL-2 was used in place of UVL-1.

Printing

Elements E-1 through E-5 and control elements C-1 through C-3 were printed using an Epson 200® printer using inks I-1 and I-2 described above. After printing, all images were allowed to dry at room temperature overnight, and the densities were measured at all steps using an X-Rite 820® densitometer. The Dmax densities at step 11 were recorded for I-1 and I-2 in Table 2 below. The images were then subjected to a high intensity daylight fading test for 2 weeks, 50Klux, 5400° K., approximately 25% RH. The Status A blue or green reflection density nearest to 1.0 was compared before and after fade and a percent density retained was calculated for the yellow and magenta dyes with each receiver element. The results can be found in Table 2 below.

TABLE 2

| Recording Element | Dmax Density, I-1 | % Retained After Fade, I-1 | Dmax Density, I-2 | % Retained After Fade, I-2 |
|---|---|---|---|---|
| E-1 | 1.59 | 86 | 1.94 | 84 |
| E-2 | 1.54 | 85 | 1.88 | 86 |
| E-3 | 1.56 | 87 | 1.92 | 86 |
| E-4 | 1.62 | 87 | 1.96 | 85 |
| E-5 | 1.53 | 84 | 1.95 | 85 |
| C-1 | 1.45 | 71 | 1.86 | 61 |
| C-2 | 1.40 | 63 | 1.83 | 60 |
| C-3 | 1.45 | 74 | 1.77 | 74 |

The above results show that the recording elements E-1 through E-5 of the invention, as compared to the control recording elements C-1 through C-3, gave higher Dmax densities and higher % retained densities after high intensity daylight fading with both inks.

Example 4

Light Stability in PVA Based Coatings

Preparation of Control Ink Recording Elements C-4 Through C-5

Control ink recording elements C-4 through C-5 were composed of a mixture of 119 g/m$^2$ of control polymer MP-2, and 9.57 g/m$^2$ of either GH-17 C-4, (Gohsenol®, 86.5–89.0% hydrolyzed, 27–33 cps) or KH-17 (C-5, Gohsenol®, 78.5–81.5% hydrolyzed, 32–38 cps) (Nippon Goshi Co.) poly(vinyl alcohol) respectively coated from distilled water.

Preparation of Control Ink Recording Elements C-6 Through C-7

Control ink recording elements C-6 through C-7 were composed of a mixture of 1.07 g/m$^2$ of control polymer MP-3, and 9.69 g/m$^2$ of either GH-17 (C-6) or KH-17 (C-7) poly(vinyl alcohol) respectively and 0.05 g/m$^2$ of Olin 10G® surfactant coated from distilled water on the above mentioned paper support. A 60:40 mixture of distilled water:methanol was used in place of distilled water to dissolve MP-3.

Preparation of Invention Ink Recording Elements E-6 Through E-7

Recording elements E-6 through E-7 of the invention were prepared analogous to E-2 above except C-4 through C-5 were overcoated using a mixture of UVL-1 and GH-17 (E-6) or KH-17 (E-7) in place of gelatin.

Preparation of Invention Ink Recording Elements E-8 Through E-9

Recording elements E-8 through E-9 of the invention were prepared analogous to E-3 above except C-6 through C-7 were overcoated using a mixture of UVL-1 and GH-17 (E-8) or KH-17 (E-9) in place of gelatin.

Preparation of Invention Ink Recording Elements E-10 Through E-11

Recording elements E-10 through E-11 of the invention was prepared by overcoating C-5 described above with a mixture of UVL-3 and KH-17 using distilled water (see Table 3 below for amounts of each).

TABLE 3

| Recording Element | g/m$^2$ of UVL-3 | g/m$^2$ of KH-17 | Final Layer Thickness (g/m$^2$) |
|---|---|---|---|
| E-10 | 0.61 | 1.51 | 2.12 |
| E-11 | 0.86 | 0.65 | 1.51 |

Printing

Elements E-6 through E-11 and control elements C-44 through C-7 were printed as described in Example 1 using I-2 and the results can be found in Table 4 below.

TABLE 4

| Recording Element | Dmax Density | % Retained After Fade |
|---|---|---|
| E-6 | 2.16 | 94 |
| E-7 | 2.16 | 94 |
| E-8 | 2.37 | 96 |
| E-9 | 2.37 | 95 |
| E-10 | 1.89 | 88 |
| E-11 | 1.79 | 85 |
| C-4 | 2.01 | 72 |
| C-5 | 2.00 | 76 |
| C-6 | 2.14 | 92 |
| C-7 | 2.19 | 93 |

The above results show that the recording elements E-6 through E-11 of the invention, as compared to the control recording elements C-4 and C-7, gave higher % retained densities after high intensity daylight fading. In addition, recording elements E-6 through E-9 gave higher Dmax densities than control recording elements C-4 through C-7.

Example 5

Preparation of a Water Soluble, Anionic Dye Ink Set, I-3 Through I-5

The Yellow ink jet ink I-3 was prepared using a standard formulation with Direct Yellow 132 (Dye 1 above, Projet Yellow 1G®, Zeneca Specialties, 10% solution in water) as the dye. The magenta ink I-4 was prepared using a standard formulation for Dye 3 above (see Dye 6 from U.S. Pat. No. 6,001,161 for specifics). The cyan ink jet ink I-5 was prepared using a standard formulation with Direct Blue 199 (see Dye 4 above, Duasyn Turquoise Blue FRL-SF® from Clariant Corp., 10% solution in water) as the dyes.

The standard formulations used for these inks include: 2-pyrrolidinone (3%); tri(ethylene glycol) (5%); glycerin (4%); Dowanol DB (2.5%) and Surfynol 465® (0.5%). For I-4, triethanolamine (0.25%) was also added. The dye concentrations for each ink were based on solution absorption spectra and chosen such that the final ink, when diluted 1:1000, would yield a transmission optical density of approximately 1.0. The percentages for each dye used are summarized in Table 5 Below.

TABLE 5

| Dye Element | Dye | % of Dye |
|---|---|---|
| I-3 | Dye 1 | 45 |
| I-4 | Dye 3 | 1.1 |
| I-5 | Dye 4 | 40 |

Printing

Elements E-6 through E-9 and control elements C-4 through C-7 from Example 4 were printed using a Lexmark Z51® ink jet printer using inks I-3 through I-5 described above. After printing, all images were allowed to dry at room temperature overnight, and the densities were measured at all steps using an X-Rite 820® densitometer. The images were then subjected to a high intensity daylight fading test for 2 weeks, 50Klux, 5400° K., approximately 25% RH. The Status A reflection densities for the single colors (yellow, magenta and cyan) and the 2 (red, green, and blue) and 3 (neutral) color combinations at 50% coverage were compared before and after fade and a percent dye retained for each was recorded. The results can be found in Tables 6 through 8 below.

TABLE 6

| Results for Single Colors | | | |
|---|---|---|---|
| Recording Element | % Retained I-3 | % Retained I-4 | % Retained I-5 |
| E-6 | 93 | 96 | 98 |
| E-7 | 98 | 96 | 100 |
| E-8 | 92 | 98 | 98 |
| E-9 | 93 | 97 | 98 |
| C-4 | 83 | 85 | 98 |
| C-5 | 81 | 82 | 100 |
| C-6 | 93 | 97 | 98 |
| C-7 | 92 | 97 | 97 |

TABLE 7

| Results for Red, Green and Blue Combinations | | | | | | |
|---|---|---|---|---|---|---|
| Receiver | % Retained, Red | | % Retained, Green | | % Retained, Blue | |
| Element | G/R | B/R | R/G | B/G | R/B | G/B |
| E-6 | 93 | 95 | 97 | 98 | 99 | 93 |
| E-7 | 105 | 101 | 101 | 99 | 103 | 102 |
| E-8 | 98 | 96 | 97 | 96 | 100 | 97 |
| E-9 | 96 | 95 | 101 | 99 | 99 | 97 |
| C-4 | 91 | 86 | 95 | 92 | 96 | 90 |
| C-5 | 89 | 84 | 96 | 91 | 95 | 89 |
| C-6 | 96 | 91 | 98 | 93 | 96 | 96 |
| C-7 | 97 | 95 | 98 | 97 | 99 | 97 |

TABLE 8

| Results for Neutral | | | |
|---|---|---|---|
| Receiver | % Retained, Neutral | | |
| Element | R/N | G/N | B/N |
| E-6 | 96 | 94 | 94 |
| E-7 | 100 | 97 | 94 |
| E-8 | 97 | 94 | 94 |
| E-9 | 96 | 93 | 93 |
| C-4 | 92 | 93 | 92 |
| C-5 | 96 | 95 | 95 |
| C-6 | 97 | 93 | 92 |
| C-7 | 99 | 95 | 95 |

The above results show that the recording elements E-6 through E-7 of the invention, as compared to the control recording elements C-4 and C-5, gave higher % retained density after high intensity daylight fading for all color combinations. Although recording elements E-8 through E-9 of the invention showed no advantage over control recording elements C-6 and C-7 in the single colors (see Table 8), they showed higher % retained densities for most 2 and 3-color combinations (see data in Tables 7 and 8).

The invention has been described in detail with particular reference to certain preferred embodiments thereof, but it will be understood that variations and modifications can be effected within the spirit and scope of the invention.

What is claimed is:

1. An ink jet printing method, comprising the steps of:

A) providing an ink jet printer that is responsive to digital data signals;

B) loading said printer with an ink jet recording element comprising a support having thereon the following layers in order:

i) a base layer comprising a polymeric binder and a polymeric mordant; and ii) an overcoat layer comprising a polymeric UV-absorbing material;

C) loading said printer with an ink jet ink composition comprising water, a humectant, and a water-soluble dye; and D) printing on said overcoat layer using said ink jet ink in response to said digital data signals; wherein said polymeric UV-absorbing material comprises the following repeating units:

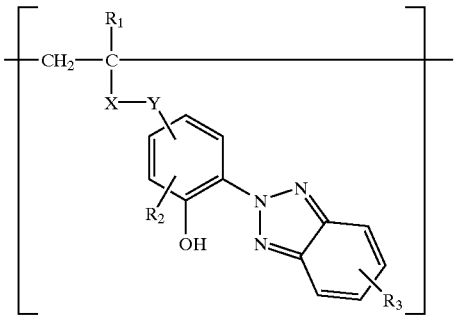

wherein:

$R_1$ represents H or $CH_3$;

$R_2$ represents H, halogen, alkoxy or a straight chain or branched alkyl group having from 1 to about 8 carbon atoms;

$R_3$ represents H, Cl, alkoxy or an alkyl group having from 1 to about 4 carbon atoms;

X represents COO, CONH or aryl; and

Y represents an alkylene group having from about 2 to about 10 carbon atoms or $(CH_2)_nO$ wherein n is 1 to about 4.

2. The method of claim 1 wherein:

$R_1$ represents $CH_3$;

$R_2$ represents H;

$R_3$ represents H;

X represents COO; and

Y represents $CH_2CH_2$.

3. The method of claim 1 wherein:

$R_1$ represents H;

$R_2$ represents H;

$R_3$ represents Cl;

X represents COO; and

Y represents $CH_2CH_2CH_2$.

4. The method of claim 1 wherein said polymeric binder is hydrophilic.

5. The method of claim 4 wherein said hydrophilic polymer is poly(vinyl alcohol) or gelatin.

6. The method of claim 1 wherein said polymeric UV-absorbing material is present in an amount from about 0.05 to about 4.0 $g/m^2$.

7. The method of claim 6 wherein said polymeric UV-absorbing material is present in an amount from about 0.2 to about 1.5 $g/m^2$.

8. The method of claim 1 wherein said polymeric mordant is cationic and is present in an amount from about 0.2 to about 16 $g/m^2$.

9. The method of claim 8 wherein said polymeric mordant is present in an amount from about 0.4 to about 8 $g/m^2$.

10. The method of claim 1 wherein said humectant is 2-pyrrolidinone, triethylene glycol or glycerin.

11. The method of claim 1 wherein said dye comprises about 0.2 to about 5% by weight of said ink jet ink composition.

12. The method of claim 1 wherein said overcoat layer contains a hydrophilic polymeric binder.

13. The method of claim 1 wherein said polymeric binder in said base layer contains particulates.

14. The method of claim 13 wherein said particulates are present in said base layer in an amount of from about 70 to about 98% by weight.

15. The method of claim 13 wherein said particulates are inorganic oxides or organic latex polymers.

16. The method of claim 13 wherein said particulates are barium sulfate, calcium carbonate, clay, silica or alumina.

17. The method of claim 1 wherein said overcoat layer contains particulates.

18. The method of claim 17 wherein said particulates are inorganic oxides or organic latex polymers.

19. The method of claim 17 wherein said particulates are barium sulfate, calcium carbonate, clay, silica or alumina.

* * * * *